United States Patent [19]

Blanchard

[11] Patent Number: 4,756,386

[45] Date of Patent: Jul. 12, 1988

[54] ADJUSTABLE COLLAPSIBLE SUPPORT STRUCTURE

[76] Inventor: Virgil Blanchard, Rte. 4, Park Rapids, Minn. 56470

[21] Appl. No.: 21,406

[22] Filed: Mar. 4, 1987

[51] Int. Cl.[4] ..... B27B 21/00

[52] U.S. Cl. ..... 182/153; 182/182; 182/222; 182/227

[58] Field of Search ..... 182/153, 182, 181, 225, 182/222, 227

[56] References Cited

U.S. PATENT DOCUMENTS

| | | | |
|---|---|---|---|
| 835,059 | 11/1906 | Curley | 182/182 |
| 1,064,334 | 6/1913 | Johnson | 182/182 |
| 1,819,252 | 8/1931 | Linsner | 182/153 |
| 2,257,876 | 10/1941 | Berchem | 182/153 |
| 2,376,787 | 5/1944 | Larson | 182/182 |
| 3,934,676 | 1/1976 | Rice | 182/182 |
| 4,238,001 | 12/1980 | Alexander | 182/153 |
| 4,375,245 | 3/1983 | Schill | 182/155 |

*Primary Examiner*—Reinaldo P. Machado

[57] ABSTRACT

A support structure is disclosed for a scaffolding system. The support structure is collapsible and adjustable in height. The support structure includes a first rigid cross bar having a first and second pair of support legs disposed at both ends of the cross bar. The support legs of the pairs are hingedly connected to the first cross bar. First and second intermediate supports are connected to opposite ends of the first cross bar and extend downwardly therefrom between opposing support legs. Releasable brace means are provided for rigidly tying free ends of the intermediate supports to opposing legs of the support structure. A second rigid cross bar is provided as being sized to extend between the first and second intermediate support structures. A lock pin releasably secures first and second ends of the second cross bar to the first and second intermediate supports at spaced intervals along the lengths of the intermediate supports.

3 Claims, 2 Drawing Sheets

FIG. 1
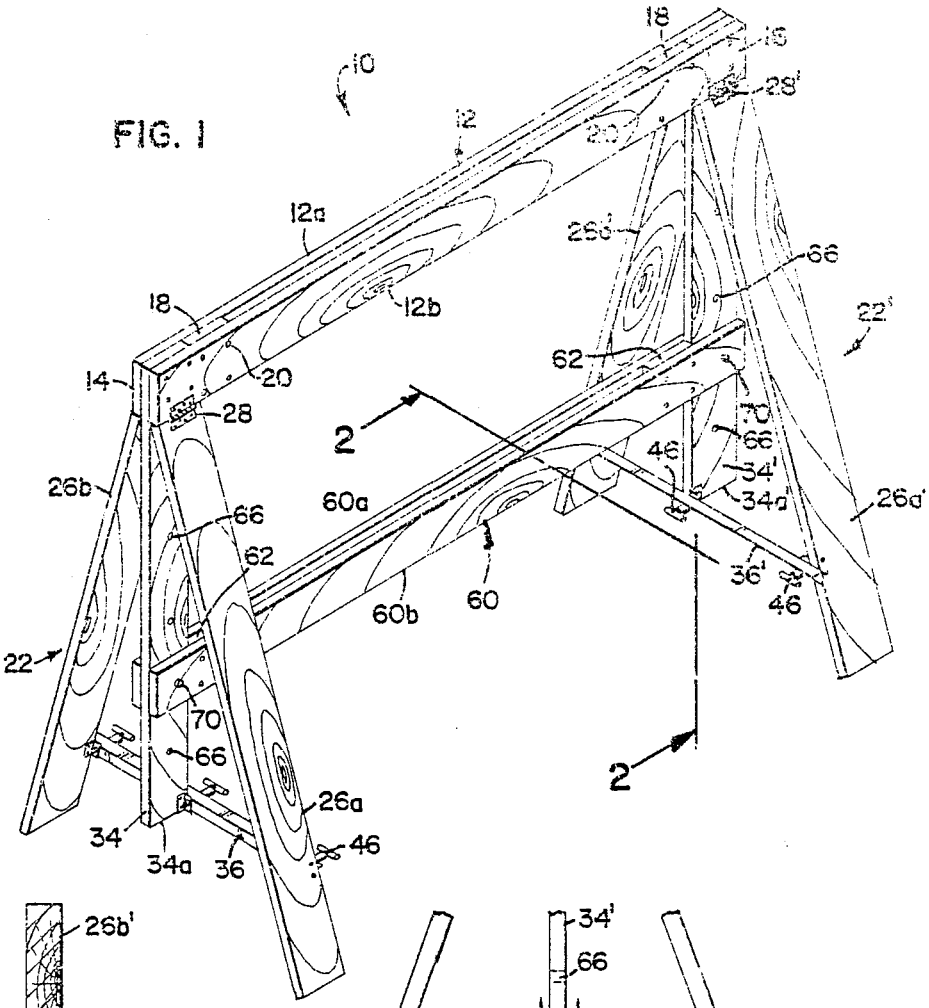
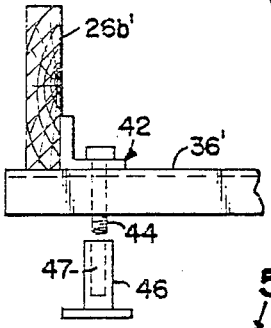
FIG. 5
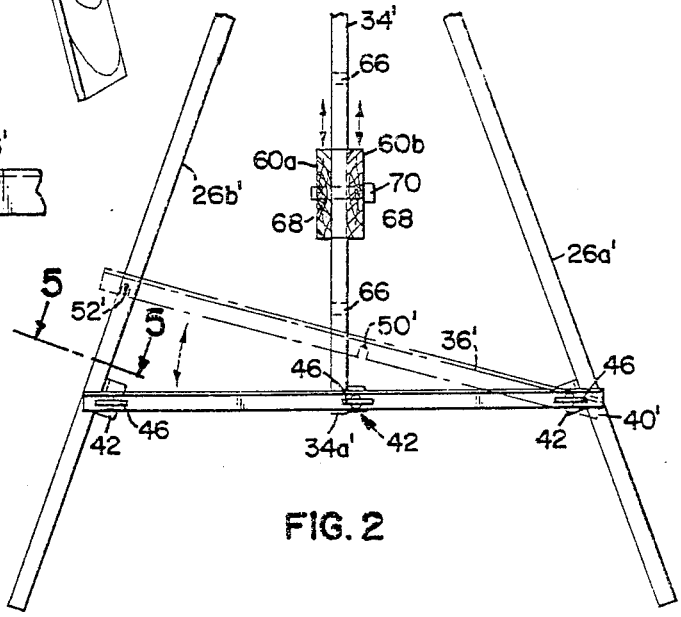
FIG. 2

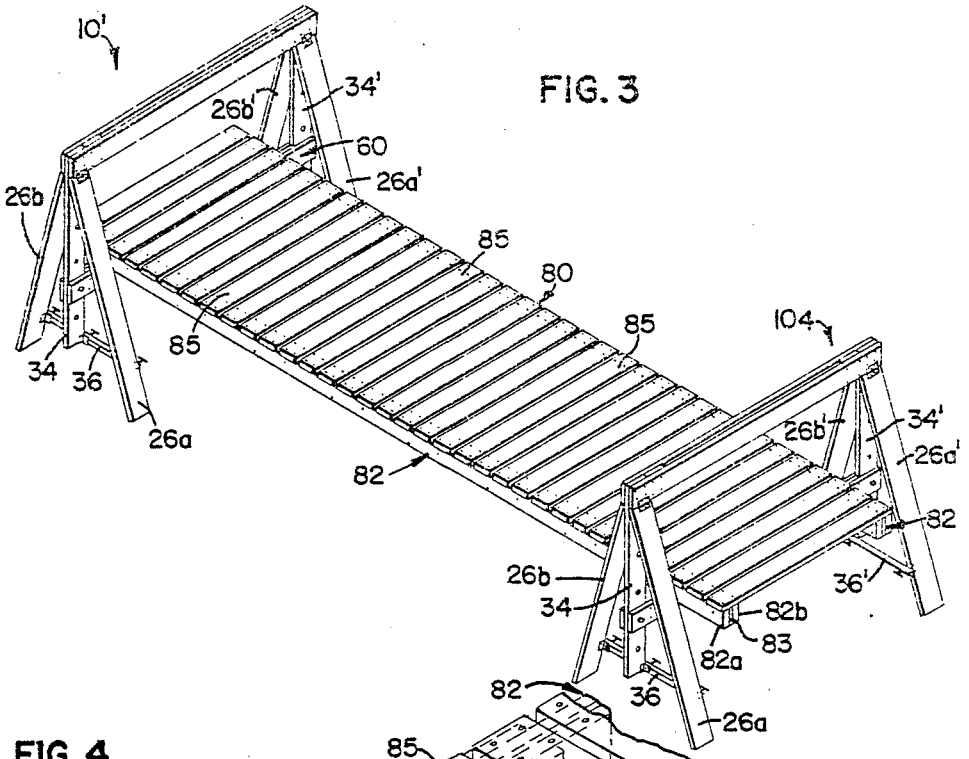
FIG. 3
FIG. 4
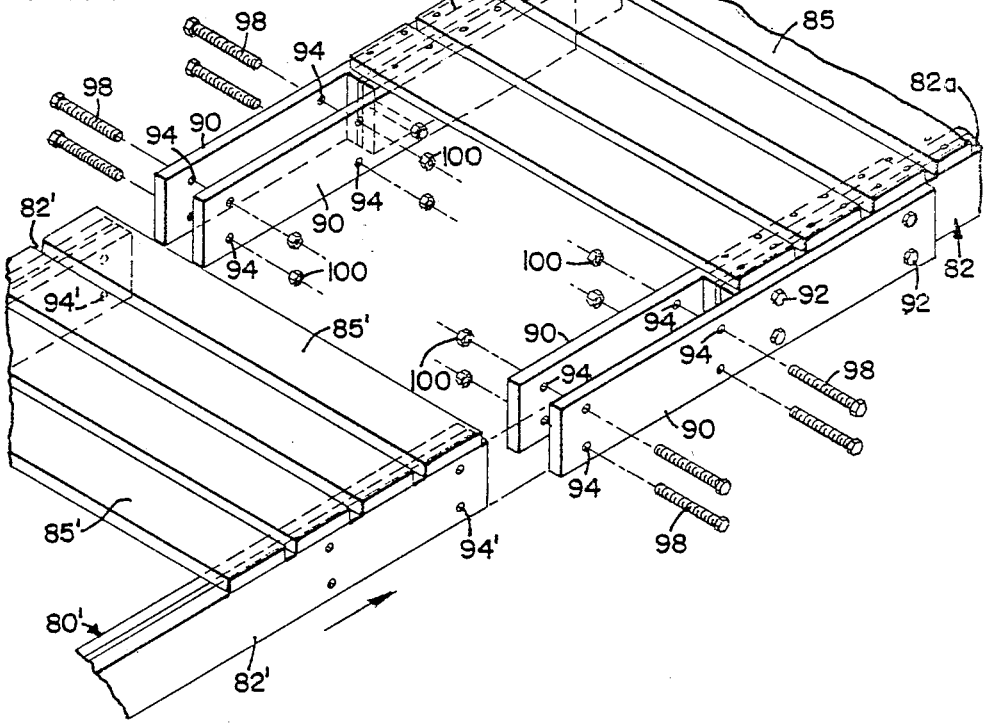

ADJUSTABLE COLLAPSIBLE SUPPORT STRUCTURE

BACKGROUND OF THE INVENTION

I. Field of the Invention

This invention pertains to a support structure. Particularly, this invention pertains to a support structure which is adjustable in a vertical dimension and collapsible for storage and transportation.

II. Background of the Invention

In the prior art, support structure such as scaffolding and the like are old and well-known. An example of a scaffold structure is shown in U.S. Pat. No. 3,934,676 to Rice dated Jan. 27, 1976. In the structure of Rice, the scaffold structure includes a pair of leg frames and a support frame. The support frame has a pair of vertical posts which are slidably received in the leg frame and can be locked to the leg frames at selected elevations. The support frame can either be disposed above the leg frames (as shown in FIG. 2 of Rice) or below the leg frames (as shown in FIG. 3 of Rice). The structure of Rice may be disassembled in a compact form for transportation.

U.S. Pat. No. 3,934,676 acknowledges the need for scaffold structures which can be disassembled or otherwise made compact for storage and transportation. In addition to these needs, scaffolding structures should be extremely sturdy in order to provide adequate load support and protection for any worker who may be using the support structure. Finally, the support structure should be of such construction that it is easily manufactured to provide a minimum cost while maximizing load bearing capabilities and safety. with these considerations in mind, I have invented an improved support structure the summary and description of which will follow.

SUMMARY OF THE INVENTION

According to a preferred embodiment of the present invention, there is disclosed a support structure having a horizontal rigid cross bar and a first and second pair of support legs. Each pair of support legs includes two legs which are disposed opposing one another with first ends of the legs pivotally connected to the horizontal cross bar. The first and second pair of support legs are disposed at opposite ends of the rigid cross bar. First and second intermediate supports are rigidly connected to opposite ends of the horizontal cross bar and extend downwardly therefrom with the first intermediate support extending between the legs of the first pair of support legs and the second intermediate support extending between the legs of the second pair of support legs. First and second rigid braces are provided with the first and second pair of support legs, respectively. The rigid braces include a first end which is pivotally secured to one leg of a support leg pair. The rigid support braces have two points of attachment spaced along the length of the rigid braces. Means are provided for rigidly connecting these support brace to the intermediate supports and the opposing leg of a support leg pair at the points of attachment. The positioning of the points of attachment are selected to have the legs evenly spaced from the intermediate supports and to rigidly tie the legs to the intermediate supports. The support structure includes a second rigid cross bar with means for releasably securing opposite ends of the second rigid cross bar to a plurality of vertically spaced apart intervals along the length of the intermediate supports.

BRIEF DESCRIPTION OF THE DRAWINGS

FIG. 1 is a perspective view of a support structure according to the present invention;

FIG. 2 is a view taken along lines 2—2 of FIG. 1 showing the support structure with a rigid brace of the support structure shown in a released position in phantom lines;

FIG. 3 is a perspective view of a scaffolding system incorporating the support structure of the present invention;

FIG. 4 is an exploded-perspective view of a coupling arrangement for a scaffolding platform to be used with the present invention; and FIG. 5 is an exploded view of a fastening mechanism to releasably connect a brace to a leg.

DESCRIPTION OF THE PREFERRED EMBODIMENT

Referring to the Figures in which identical parts are numbered consistently throughout, a support structure of the present invention is shown generally at 10. The support structure includes a first rigid cross bar 12 extending between first and second ends 14,16 respectively.

The first rigid cross bar 12 is preferably formed of a pair of wooden boards **12*a* and 12*b* which are maintained in spaced apart relation by a pair of spacers 18. Boards 12*a* and 12*b* are secured in parallel alignment to spacers 18 by means of a plurality of screws 20**.

The support structure 10 includes a plurality of support legs **26*a*, 26*b*, 26*a*' and 26*b*'. The legs are grooved into a first pair 22 consisting of legs 26*a* and 26*b* and a second pair 22' consisting of legs 26*a*' and 26*b*'. Each pair 22,22' is identical and a description of one will suffice as a description of the other. As shown, the legs 26*a*,26*b* of pair 22 have first ends which are hingedly connected to end 14 of cross bar 12. The connection is performed by means of a hinge plate 28. The hinge plate connecting leg 26*b* is not shown but is identical to that connecting leg 26*a* to end 14. Legs 26*a*' and 26*b*' are similarly connected to end 16 of cross bar 12**.

First and second intermediate supports 34,34' are provided extending downwardly from first and second ends 14,16, respectively of first rigid cross bar 12. Second intermediate supports 34,34' extend between opposing legs of the first and second pairs 22,22' of support legs 26. Intermediate supports 34,34' terminate at free ends **34*a*,34*a*'**.

A first rigid brace 36 is provided for rigidly bracing legs **26*a* and 26*b* with first intermediate support 34. Similarly, rigid brace 36' is provided for rigidly bracing legs 26*a*',26*b*' and second intermediate support 34'**.

Each of braces 36 and 36' are formed from angle iron and are identical. A description of brace 36' with reference to FIG. 2 will suffice as a description of brace 36.

As shown in FIG. 2, a first end 40' of brace 36' is pivotably secured to leg **26*a*'. The pivotable securement is provided by means of a mounting bracket 42 which is securely mounted to leg 26*a*' and presents a surface opposing brace 36'**.

A hole is formed through brace 36' at first end 40' and aligned to receive a threaded shaft 44 extending from bracket 42. As shown in the drawings, six brackets 42 are used in the invention. The structure of the brackets are most clearly shown in FIG. 5. A wing nut 46 having an internally threaded bore 47 is received on shaft 44 and captures first end 40' on mounting bracket 42. Free end 34a' of second intermediate support 34' and leg 26b' are each provided with mounting brackets which are identical in construction with mounting bracket 42 of leg 26a' and, accordingly, are identically numbered.

The brackets 42 are positioned on legs 26a',26b' and intermediate support 34' such that the shafts 44 of the brackets 42 are aligned in linear alignment when the legs 26a' and 26b' are spaced apart in a predetermined position corresponding with the position the legs are to assume when the support structure 10 is in use. Brace 36' includes spaced apart notches 50' and 52' which are disposed to align with the threaded shafts 44 of the mounting brackets 42 connected to the intermediate support 34 and leg 26b', respectively, when legs 26b' and 26a' are spaced apart with all of shafts 44 in linear alignment. Notches 50' and 52' are sized to receive shafts 44 when brace 36' is pivoted to a down position as shown in the solid lines in FIG. 2. So positioned, wing nuts 46 may be tightened urging the brace 36' against each of mounting brackets 42. In this manner, the free end 34a' of intermediate support 34' and leg 26a' and leg 26b' are all rigidly tied together. Also, in this position, the legs are rigidly fixed in their operating position.

For transportation and storage, wing nuts 46 may be loosened whereby braces 36 and 36' may be moved upwardly (as shown in the phantom lines of FIG. 2) so that shafts 44 are removed from notches 50' and 52'. With braces 36 and 36' so lifted, the legs 26a and 26b may be compressed toward one another. Likewise, legs 26a' and 26b' may be compressed toward one another so that the entire support structure is flat.

The support structure includes a second rigid cross bar 60 which is constructed of two board members 60a and 60b maintained in spaced apart parallel alignment by spacers 62. Spacers 62 are selected to have a thickness generally equal to the thickness of intermediate supports 34,34' with the spacers 62 disposed so that intermediate supports 34,34' may be received between opposing members 60a,60b on opposite ends of second rigid cross member 60.

As shown in the drawings, intermediate supports 34,34' include a plurality of horizontally aligned holes 66. Likewise, free ends of members 60a,60b opposing intermediate supports 34,34' are provided with holes 68 therethrough positioned to be axially aligned with the holes 66 of the supports when the second cross member 60 is received on the supports 34,34' as shown in the Figures. A lock pin 70 is provided sized to be received and extend through the holes 68 of the second cross bar 60 and the holes 66 of the intermediate supports 34,34'.

With the intermediate supports and the second cross bar 60 as described, the cross bar 60 can be raised or lowered on intermediate supports 34,34' by simply removing lock pin 70 and sliding the second rigid cross bar 60 up or down until its holes 68 come in alignment with holes 66 corresponding with a desired position. When this alignment is achieved, the lock pin 70 may be reinserted and the second rigid cross bar is now secured to the intermediate supports 32,34 at a desired elevation.

From the foregoing, it can be seen that the support structure 10 can be made of readily available materials. The support structure is collapsible by loosening wing nuts 46 and raising the braces 36,36'. With the braces so raised, the opposing leg pairs, 26a,26b and 26a',26b' may be compressed so that the support structure is collapsible for storage and transportation. When in use, with the cross braces 36,36' in their lowered position, the legs are maintained in rigid fixed desired positions. Also, the cross braces complete a rigid tie between the legs and the intermediate support members to complete a structural triangle between all members. Accordingly, the free ends 34,34' of the intermediate supports 34,34' are rigidly tied and secured in a fixed position. Finally it is apparent that with the apparatus so rigidly completed, the second rigid cross bar 60 may be raised or lowered to any of a plurality of fixed positions.

With a support structure as described, a pair of support structures may be used to complete a scaffolding system. In FIG. 3, first and second support structures 10' and 10'' are shown supporting a scaffold platform 80. While platform 80 could be of any desired construction. A preferred construction includes a platform 80 formed of two parallel spaced apart rigid rails 82 each of which is identical. The rails 82 consist of board members 82a and 82b with a length of plywood 83 sandwiched between board members 82a,82b. By fastening the board members 82a,82b and the sandwiched plywood 83 together, through the use of screws or other suitable fasteners, the rails 82 are rigid composite beams. The rails 82 are connected by a plurality of transverse boards 85.

The structure of the scaffolding system of FIG. 3 provides for a very rigid and secure scaffold. The scaffold platform 80 rests on the second rigid cross bars 60. The second rigid cross bars are secured to the intermediate supports structures 34,34'. These support structures are maintained in rigid vertical planes by reason of their being rigidly tied to the legs 26a,26b, 26a',26b' by the cross braces 36,36'. The platform itself, due to the rigid construction of the rails 82, is a high load bearing platform. By reason of the foregoing construction, this high load bearing platform can be raised or lowered by simply raising or lowering second rigid cross bars 60 as previously described.

In the event an extended platform 80 is desired, two platforms may be joined together in the manner shown in FIG. 4. As shown in FIG. 4, extender plates 90 are secured to the outer surfaces of each of boards 82a and 82b of a rail 82. The extenders 90 are secured by reasons of bolts 92. The extenders 90 extend beyond the free ends of the platform 80 and include holes 94 aligned with holes 94' formed through the rails 82' of a contiguous platform 80'.

By slidably receiving the rails 82' of the contiguous platform 80' into the space defined between extenders 90, bolts 98 may be passed through the aligned holes 94 and 94' and secured by nuts 100 to form a rigid extension of the platform 80. The extended platform 80 can then be received with free ends of original platform 80 and the free end of contiguous platform 80' resting of the second cross bars of the support structures 10' and 10'' of FIG. 3.

From the foregoing detailed description of the present invention, it has been shown how the objects of the invention have been attained in a preferred manner. However, modifications and equivalents of the disclosed concepts, such as readily occur to those skilled in the art, are intended to be included in the scope of this invention. Thus, the scope of the invention is intended to be limited only by the scope of the claims as are, or may hereafter be, appended hereto.

What is claimed is:

1. A support structure comprising:

a first rigid cross bar;

a first pair of support legs having first ends thereof connected to a first end of said first cross bar and each extending therefrom to second end of said first cross bar and each extending therefrom to second ends of said support legs;

a second pair of support legs having first ends thereof secured to a second ends of said support legs of said second pair;

said legs of said second pair disposed opposing one another and said legs of said first pair disposed opposing one another, said first ends of said legs hingedly connected to said first cross bar for opposing legs to pivot toward and away from one another;

a first intermediate support having a first end connected to said first end of said first cross bar and extending therefrom to a second end, said first intermediate support extending between said support legs of said first pair;

a second intermediate support having a first end connected to said second end of said first cross bar and extending therefrom to a second end with said second intermediate support disposed between said support legs of said second pair;

a second rigid cross bar sized to extend between said first and second intermediate supports;

means for releasably securing first and second ends of said second cross bar to said first and second intermediate supports, respectively, at spaced intervals along the lengths of said first and second intermediate supports; and means for releasably holding said second ends of said legs in rigid spaced apart alignment and including first and second rigid braces respectively associated with said first and second pairs of legs, a first end of said braces pivotally secured to one of said legs and means for releasably attaching a second end of said braces to an opposing leg, said braces sized to hold said opposing legs apart a predetermined distance, intermediate locking means for releasably locking an intermediate location of said brace to said intermediate support structure.

2. A support structure comprising:

(a) a generally horizontal first rigid cross bar;

(b) a first pair of support legs disposed opposing one another with first ends thereof pivotally connected to a first end of said first rigid cross bar;

(c) a second pair of support legs having first ends thereof pivotally connected to a second end of said first rigid cross bar;

(d) legs of said first and second pairs extending beneath said first cross bar and terminating at second ends;

(e) a first intermediate support having a first end connected to said first end of said first rigid cross bar, said first intermediate support extending from said first end between said legs of said first pair;

(f) a second intermediate support having a first end connected to said second end of said first rigid cross bar, said second intermediate support extending from said first end and between said opposing legs of said second pair; and (g) first and second brace means for bracing, respectively, legs of said first pair and legs of said second pair, each of said brace means having a first end pivotally secured to one of said legs of said pair and a second end having a predetermined end point of attachment with means for releasably connecting said end point of attachment to an opposing leg, said brace further including an intermediate point of attachment spaced generally centrally between said end point of attachment and said first end with means for releasably connecting said intermediate point of attachment to said intermediate support extending between said opposing legs, said brace having a predetermined length with said first point of attachment and intermediate point of attachment being disposed at spaced intervals along said length for said brace to hold each of said opposing legs in rigid predetermined spacing from said intermediate support when said points of attachment are secured to said leg and said intermediate support.

3. A support structure according to claim 2 comprising a second rigid cross bar sized to extend between said first and second intermediate supports with means for releasably securing first and second ends of said second cross bar to said first and second intermediate supports, respectively, at spaced intervals along the length of said supports.

* * * * *